US009544684B2

(12) United States Patent
Gohara

(10) Patent No.: US 9,544,684 B2
(45) Date of Patent: Jan. 10, 2017

(54) SOUND DETERMINATION UNIT BASED ON MEAN AMPLITUDES OF PARTIAL SOUND SEGMENTS

(71) Applicant: NINTENDO CO., LTD., Kyoto (JP)

(72) Inventor: Shigetoshi Gohara, Kyoto (JP)

(73) Assignee: NINTENDO CO., LTD., Kyoto (JP)

( * ) Notice: Subject to any disclaimer, the term of this patent is extended or adjusted under 35 U.S.C. 154(b) by 252 days.

(21) Appl. No.: 14/496,546

(22) Filed: Sep. 25, 2014

(65) Prior Publication Data

US 2015/0139431 A1 May 21, 2015

(30) Foreign Application Priority Data

Nov. 18, 2013 (JP) ..... 2013-238008

(51) Int. Cl.
*H04R 29/00* (2006.01)
*H04R 3/00* (2006.01)

(52) U.S. Cl.
CPC ..... *H04R 3/00* (2013.01); *H04R 2410/00* (2013.01); *H04R 2420/07* (2013.01)

(58) Field of Classification Search
CPC ..... H04R 29/00; H04R 29/004
USPC ..... 381/56
See application file for complete search history.

(56) References Cited

U.S. PATENT DOCUMENTS

2006/0107824 A1 5/2006 Bando et al.
2006/0182291 A1* 8/2006 Kunieda ..... G10L 15/00 381/110
2010/0111313 A1* 5/2010 Namba ..... H04R 3/005 381/56
2011/0103596 A1* 5/2011 Yamada ..... H04R 29/00 381/56

FOREIGN PATENT DOCUMENTS

JP 2006-145851 6/2006

* cited by examiner

*Primary Examiner* — Paul S Kim
*Assistant Examiner* — Katherine Faley
(74) *Attorney, Agent, or Firm* — Nixon & Vanderhye P.C.

(57) ABSTRACT

An example information processing device determines a sound input to a microphone. The information processing device includes an obtaining section, a mean amplitude calculation section, and a determination section. The obtaining section obtains data of a sound detected by the microphone. For a sound of a predetermined determination segment, the mean amplitude calculation section calculates a mean amplitude, which is an average amplitude, for each of a plurality of partial segments included in the determination segment. The determination section determines whether or not the sound input to the microphone is a predetermined type of a sound (e.g., a sound made by breath blowing) based on the mean amplitudes for the partial segments.

16 Claims, 7 Drawing Sheets

SOUND DETERMINATION UNIT BASED ON MEAN AMPLITUDES OF PARTIAL SOUND SEGMENTS

CROSS REFERENCE TO RELATED APPLICATION

The disclosure of Japanese Patent Application No. 2013-238008, filed on Nov. 18, 2013, is herein incorporated by reference.

FIELD

The present technique relates to a storage medium storing an information processing program for determining whether or not an input sound is a predetermined type of a sound (e.g., a sound made by breath blowing), an information processing device, an information processing system, and a sound determination method.

BACKGROUND AND SUMMARY

There are conventional techniques for detecting an input of a breath blown against a microphone. For example, a conventional breath blowing determination device is provided in advance with a frequency distribution representing a sound made by breath, and detects the frequency distribution of a sound input on a microphone. Then, the determination device determines whether or not a breath-blowing input has been made by determining whether or not the provided frequency distribution matches with the frequency distribution of the detected input sound.

With conventional methods, however, the processing burden may become large due to frequency analysis and frequency distribution matching processes.

Thus, the present application discloses a storage medium storing an information processing program, an information processing device, an information processing system, and a sound determination method, with which it is possible to determine an input sound by a simple method.

(1)

An example storage medium described herein is a computer-readable storage medium storing an information processing program to be executed by a computer of an information processing device for determining a sound input to a microphone. The information processing program causes the computer to function as an obtaining unit, a mean amplitude calculation unit, and a determination unit. The obtaining unit obtains data of a sound detected by the microphone. For a sound of a predetermined determination segment, the mean amplitude calculation unit calculates a mean amplitude, which is an average amplitude, by using the obtained data of the sound, for each of a plurality of partial segments included in the determination segment. The determination unit determines whether or not the sound input to the microphone is a predetermined type of a sound based on the mean amplitudes for the partial segments.

The term "determining whether or not the sound is a predetermined type of a sound" as set forth above means to include "determining whether the sound is a predetermined type of a sound or another type of a sound". That is, the determination unit may be a unit that only detects the predetermined type of a sound and does not detect other types of sounds, or may be a unit that detects, and distinguishes between, the predetermined type of a sound and other types of sounds.

With configuration (1) above, based on the mean amplitudes for the partial segments, it is possible to know, by a simple method, the amount of frequency components below the frequency corresponding to the length of a partial segment. That is, with configuration (1) above, it is possible to make the determination by the simple method of calculating the mean amplitudes, without having to perform a complicated process such as frequency analysis (frequency conversion) and frequency spectrum pattern matching.

(2)

The determination unit may calculate an absolute value of the mean amplitude for each partial segment, and make the determination based on the calculated absolute values.

With configuration (2) above, the determination is made based on the absolute value of the mean amplitude, which is an index representing the amount of components below the frequency corresponding to the partial segment of the sound of the determination segment. That is, the determination can be made based on the amount of components below the frequency corresponding to the length of a partial segment. Thus, it is possible to precisely make the determination.

(3)

The determination unit may calculate an average value among the absolute values, and make the determination based on a determination value which is based on the calculated average value.

With configuration (3) above, by using the average value, it is possible to easily determine a particular type of a sound (e.g., a sound made by breath blowing) having components below the frequency corresponding to the length of a partial segment.

(4)

The determination unit may calculate a difference between two mean amplitudes for two partial segments next to each other within the determination segment for each pair of two partial segments next to each other, and make the determination by using a determination value which is based on absolute values of the differences.

With configuration (4) above, it is possible to determine a particular type of a sound (e.g., a sound made by breath blowing) having components below a frequency corresponding to the length of a partial segment and above a frequency corresponding to the length of two partial segments. Then, it is possible to distinguish between a particular type of a sound and another type of a sound having a lower frequency than the sound, and it is therefore possible to more precisely make the determination.

(5)

The determination unit may calculate a difference between a mean amplitude for one partial segment and a mean amplitude for a group segment, which is made up of two or more successive partial segments including the one partial segment for each partial segment, and make the determination by using a determination value which is based on absolute values of the differences.

With configuration (5) above, it is possible to determine a particular type of a sound having components below a frequency corresponding to the length of a partial segment and above a frequency corresponding to the length of a partial segment multiplied by a predetermined number (the number of partial segments included in a group segment). Then, it is possible to distinguish between a particular type of a sound and another type of a sound having a lower frequency than the sound, and it is therefore possible to more precisely make the determination.

(6)

The determination unit may make the determination based on a comparison between the determination value and a predetermined threshold value.

With configuration (6) above, it is possible to easily perform the determination process using the determination value.

(7)

The determination unit may make the determination based on a ratio of the determination value with respect to a sound volume over the determination segment.

With configuration (7) above, it is possible to precisely perform the determination process using the determination value.

(8)

The determination unit may determine whether or not a sound input to the microphone is a sound made by breath blowing.

With configuration (8) above, it is possible to detect, by a simple method, a sound made by breath blowing which is input to the microphone. For example, it is possible to distinguish between a voice and breath blowing, and to perform a predetermined process in response to a breath-blowing input.

(9)

The determination unit may determine whether or not the sound input to the microphone is a sound made by a voice.

With configuration (9) above, it is possible to detect, by a simple method, a sound made by a voice input to the microphone. For example, it is possible to distinguish between a voice and breath blowing, and to perform a predetermined process in response to a voice input.

(10)

A plurality of partial segments included in the determination segment may be set to a generally equal length.

With configuration (10) above, it is possible to precisely calculate the amount of components below a predetermined frequency which is determined based on the length of each partial segment of the sound of the determination segment, thereby enabling precise determination.

(11)

The partial segment may be set to a length of 1/700 [sec] or more.

With configuration (11) above, it is possible to detect, by a simple method, a sound made by breath blowing which is input to the microphone.

(12)

The partial segment may be set to a length of 1/400 [sec] or more.

With configuration (12) above, it is possible to detect, by a simple method, a sound made by breath blowing which is input to the microphone.

Note that the present specification discloses an information processing device and an information processing system having units equivalent to those realized by executing the information processing program of (1) to (12) above. The present specification also discloses a sound determination method to be carried out in (1) to (12) above.

Thus, with the storage medium storing an information processing program, the information processing device, the information processing system and the sound determination method set forth above, it is possible to determine an input sound by a simple method.

These and other objects, features, aspects and advantages will become more apparent from the following detailed description when taken in conjunction with the accompanying drawings.

DETAILED DESCRIPTION OF NON-LIMITING EXAMPLE EMBODIMENTS

[1. Configuration of Information Processing System]

Figure 1:
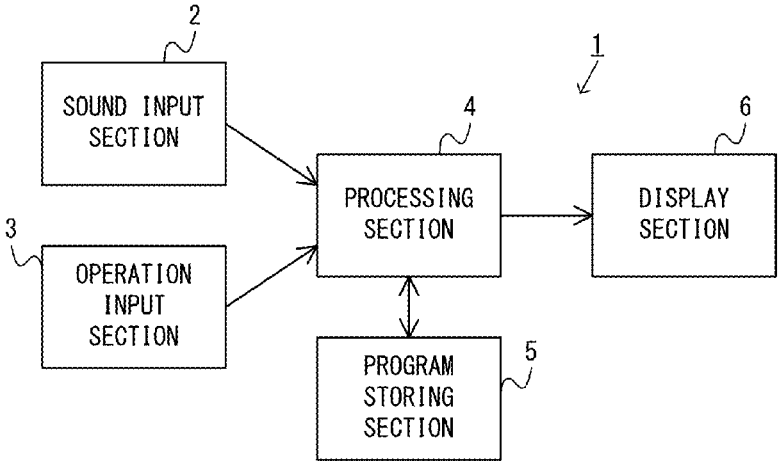
FIG. 1 is a block diagram showing a configuration of an example information processing device according to the present embodiment.

A storage medium storing an information processing program, an information processing device, an information processing system, and a sound determination method according to an example of the present embodiment will now be described. First, a configuration of an information processing device (information processing system) will be described. FIG. 1 is a block diagram showing a configuration of an example information processing device according to the present embodiment. As shown in FIG. 1, the information processing device 1 includes a sound input section 2, an operation input section 3, a processing section 4, a program storing section 5, and a display section 6. The information processing device 1 may be any form of an information processing device, such as a game device, a personal computer, a mobile terminal, and a smartphone, for example. In the present embodiment, the information processing device 1 determines whether or not a breath-blowing input has been made by determining whether or not a sound input on the sound input section 2 is a sound made by breath blowing. The various sections of the information processing device 1 will now be described.

The sound input section 2 includes a microphone and detects ambient sounds (including a breath-blowing input by a user). Note that other than the breath-blowing input, a voice input may be made on the microphone. A sound signal detected by the microphone undergoes A/D conversion (including sampling) by means of a processing circuit of the sound input section 2, and sound data obtained by the A/D conversion is output to the processing section 4.

The operation input section 3 may be any input device capable of accepting an operation input from a user, such as a button (key), a touch panel and/or a mouse, etc. Data representing a operation input from a user accepted by the operation input section 3 is output to the processing section 4.

The processing section 4 performs various information processes (e.g., a breath determination process to be described later), which are performed in the information processing device 1, using data from the sound input section 2 (and the operation input section 3) as necessary. The processing section 4 includes a CPU (Central Processing Unit) and a memory, and the various information processes are performed by the CPU executing predetermined information processing programs using the memory.

The program storing section 5 stores the information processing programs executed in an information processing system 1. The program storing section 5 may be any storage medium that can be accessed by the processing section 4. The program storing section 5 may be a storing section provided in the information processing device 1, such as a hard disk or a memory, for example, or it may be a storage medium that can be inserted/removed into/from the information processing device 1, such as an optical disc or a cartridge, for example.

The display section 6 is a display device for displaying an image produced by an information process performed by the processing section 4. Note that the information processing device 1 does not need to have the display section 6. The information processing device 1 may transmit an image to a display device (e.g., a TV) separate from the information processing device 1 itself, for example, so that the image is displayed on the display device.

Note that in an alternative embodiment, an information processing system, which includes a plurality of devices, may include various sections of the information processing device 1 described above. For example, in an alternative embodiment, the information processing system may include a main information processing device, which includes the processing section 4 and performs information processes, and a terminal device including the sound input section 2, the operation input section 3 and the display section 6. In an alternative embodiment, at least some of the information processes performed by the information processing device 1 may be distributed among a plurality of devices capable of communicating with one another by a network (a wide area network and/or a local network).

[2. Outline of Breath Determination Process in Information Processing Device]

Figure 2:
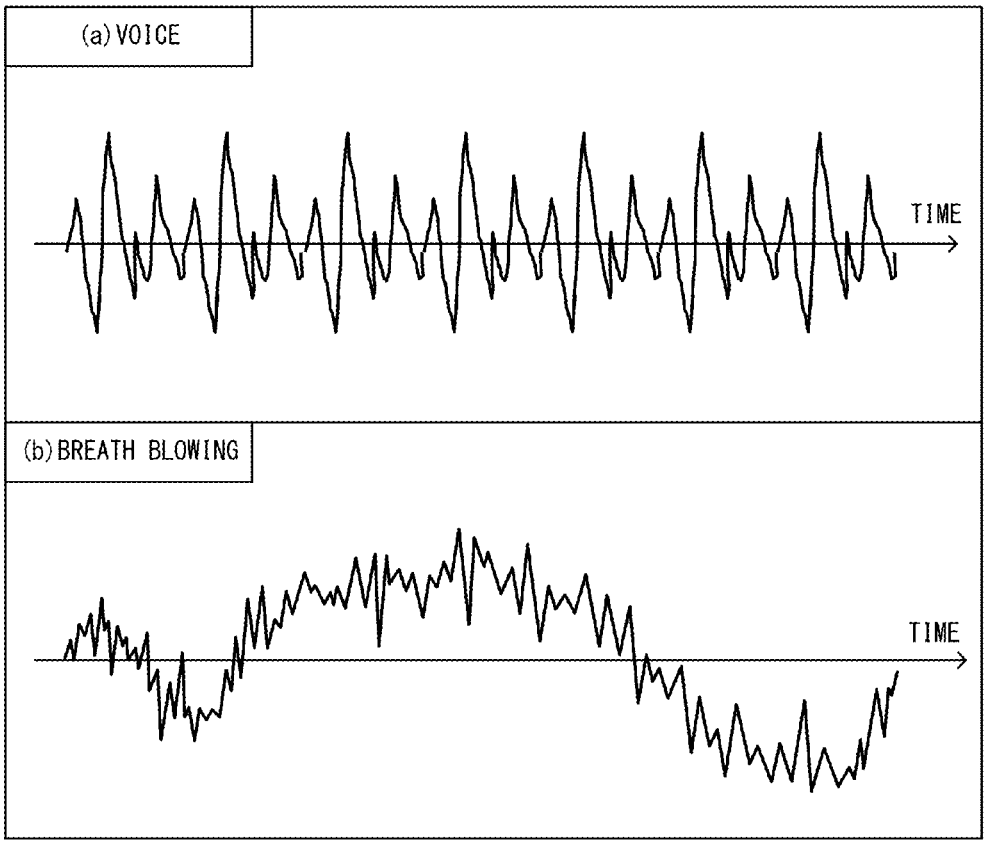
FIG. 2 is a diagram schematically showing an example sound waveform for a case where a voice (a sound made by a voice) is input and for a case where a breath (a sound made by breath blowing) is input.

Next, referring to FIGS. 2 to 7, an outline of the process performed by (the processing section 4 of) the information processing device 1 will be described. FIG. 2 is a diagram schematically showing an example sound waveform for a case where a voice (a sound made by a voice) is input and for a case where a breath (a sound made by breath blowing) is input. Where a user's voice is input to the sound input section 2, the sound to be detected by the sound input section 2 will have a waveform with a strong periodicity which dominantly has relatively high frequencies as shown in (a) of FIG. 2 (see (a) and (b) of FIG. 9). On the other hand, where a user's breath is input to the sound input section 2, the sound to be detected by the sound input section 2 will have a waveform which is disturbed by the wind pressure of the breath and which has relatively low frequencies as shown in (b) of FIG. 2 (see (c) of FIG. 9). In the present embodiment, the information processing device 1 performs a breath determination process to be described below to distinguish an input voice and an input breath from each other so as not to determine that a breath-blowing input has been made when a voice is detected and to determine that a breath-blowing input has been made if a breath is detected.

(Partial Segment)

Figure 3:
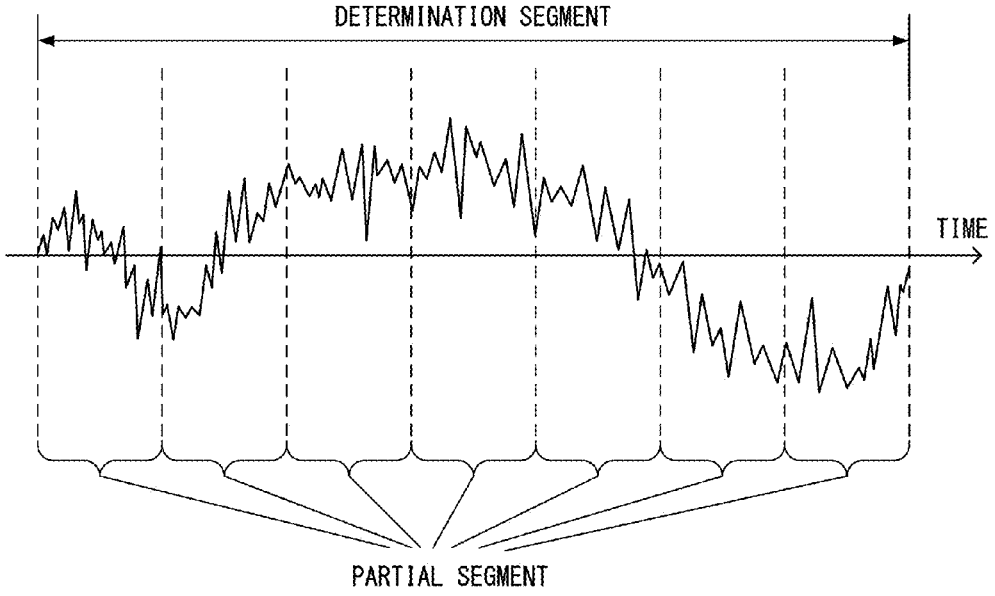
FIG. 3 is a diagram showing an example of a determination segment and partial segments set for a detected sound in the present embodiment.

FIG. 3 is a diagram showing an example of a determination segment and partial segments set for a detected sound in the present embodiment. In FIG. 3, a determination segment is a segment of the sound detected by the sound input section 2 that is subjected to a determination of whether it is a breath (a sound made by breath blowing). That is, the information processing device 1 sets a determination segment, and determines whether or not the sound of the determination segment is a breath. Note that a plurality of determination segments are set in the present embodiment, and it is determined whether or not a breath-blowing input has been made based on determination results for the plurality of determination segments, the details of which will be described later (see steps S6 and S7 to be described below).

As shown in FIG. 3, a plurality of (seven in FIG. 3) partial segments are set within one determination segment. The length of one partial segment is set taking into consideration the frequency of the sound to be detected (a sound made by breath blowing in the present embodiment). It is believed that a sound made by breath blowing to be detected in the present embodiment contains frequency components below 160 [Hz], the details of which will be described later (see FIG. 9). Therefore, in the present embodiment, the length of a partial segment is set to 1/320 [sec], which is half the wavelength of 160 [Hz].

(Process to be Performed on Sound of Determination Segment)

Next, referring to FIGS. 4 to 7, a process for determining whether or not a sound of the determination segment is a breath will be described. After sound data of the determination segment is obtained from the sound input section 2, the processing section 4 calculates the average amplitude value (referred to as the "mean amplitude") for each of the partial segments in the determination segment by using the obtained sound data.

Figure 4:
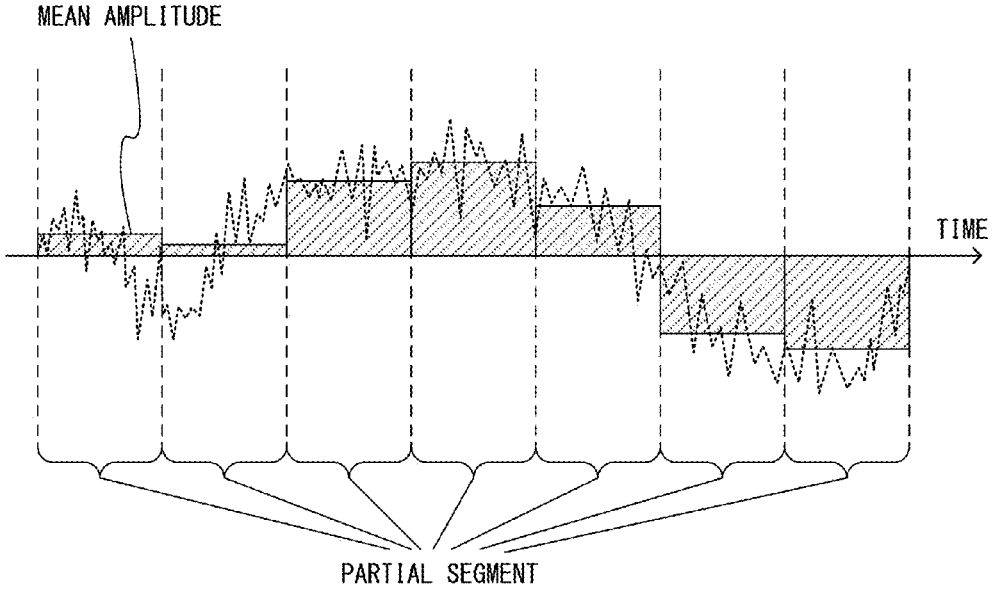
FIG. 4 is a diagram showing a mean amplitude for each partial segment of a sound of an example waveform shown in (b) of FIG. 2.
Figure 5:
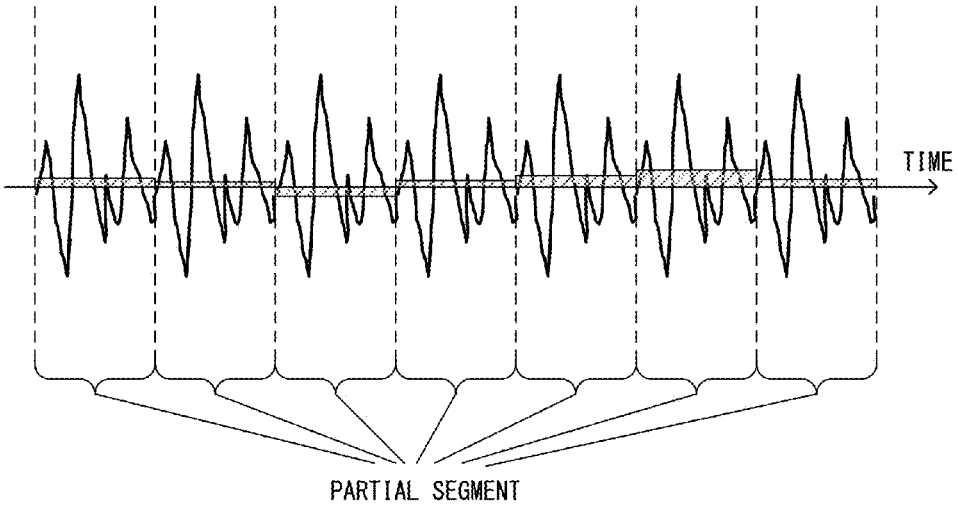
FIG. 5 is a diagram showing a mean amplitude for each partial segment of a sound of an example waveform shown in (a) of FIG. 2.

FIG. 4 is a diagram showing a mean amplitude for each partial segment of a sound of a waveform shown in (b) of FIG. 2. FIG. 5 is a diagram showing a mean amplitude for each partial segment of a sound of a waveform shown in (a) of FIG. 2. Herein, if the sound of the determination segment is a breath, it contains a large amount of frequency components below the frequency corresponding to the length of a partial segment. Therefore, in such a case, as shown in FIG. 4, (the absolute value of) the mean amplitude of a partial segment can be a relatively large value. On the other hand, if the sound of the determination segment is a voice, it contains a small amount of frequency components below the frequency corresponding to the length of a partial segment. Therefore, in such a case, as shown in FIG. 5, (the absolute value of) the mean amplitude of a partial segment can be a relatively small value.

After the mean amplitude for each partial segment is calculated, the processing section 4 calculates the absolute value of each mean amplitude, and calculates the average among the absolute values (referred to as the "absolute mean"). In the present embodiment, the processing section 4 further calculates the mean amplitude for the entire determination segment (referred to as the "overall mean"), and calculates the determination value by subtracting the overall mean from the absolute mean.

The processing section 4 determines whether or not the sound of the determination segment is a breath by using the determination value calculated as described above. Specifically, the processing section 4 determines that the sound of the determination segment is a breath if the determination value is greater than a predetermined threshold value, and determines that the sound of the determination segment is not a breath if the determination value less than or equal to the threshold value.

Figure 6:
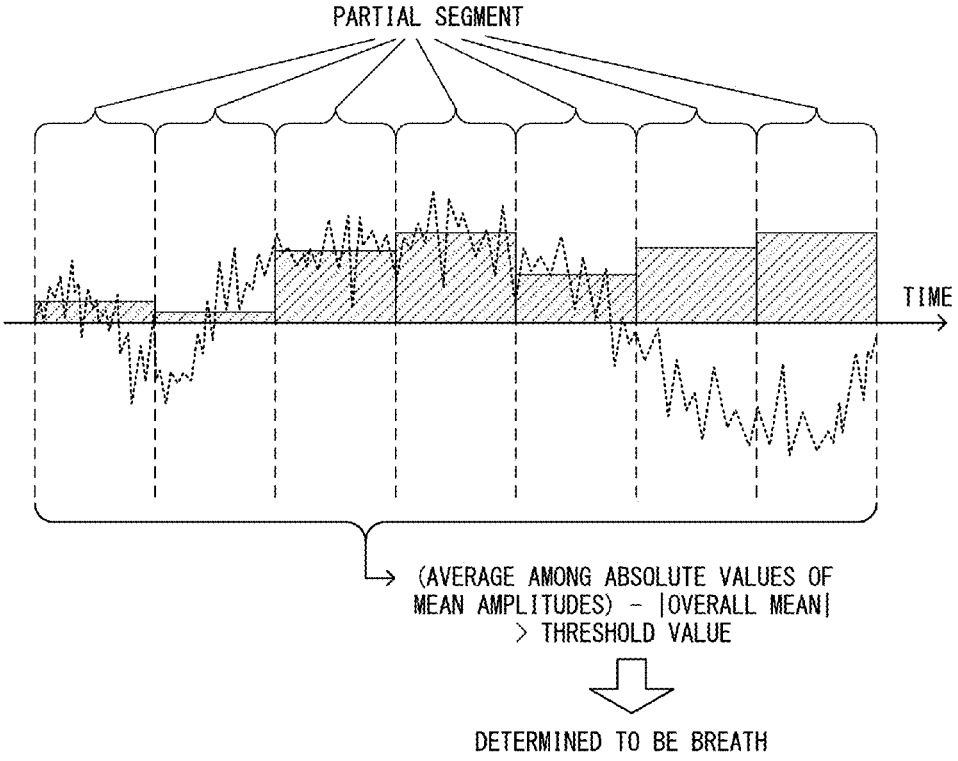
FIG. 6 is a diagram illustrating an example determination process for a sound of a waveform shown in (b) of FIG. 2.
Figure 7:
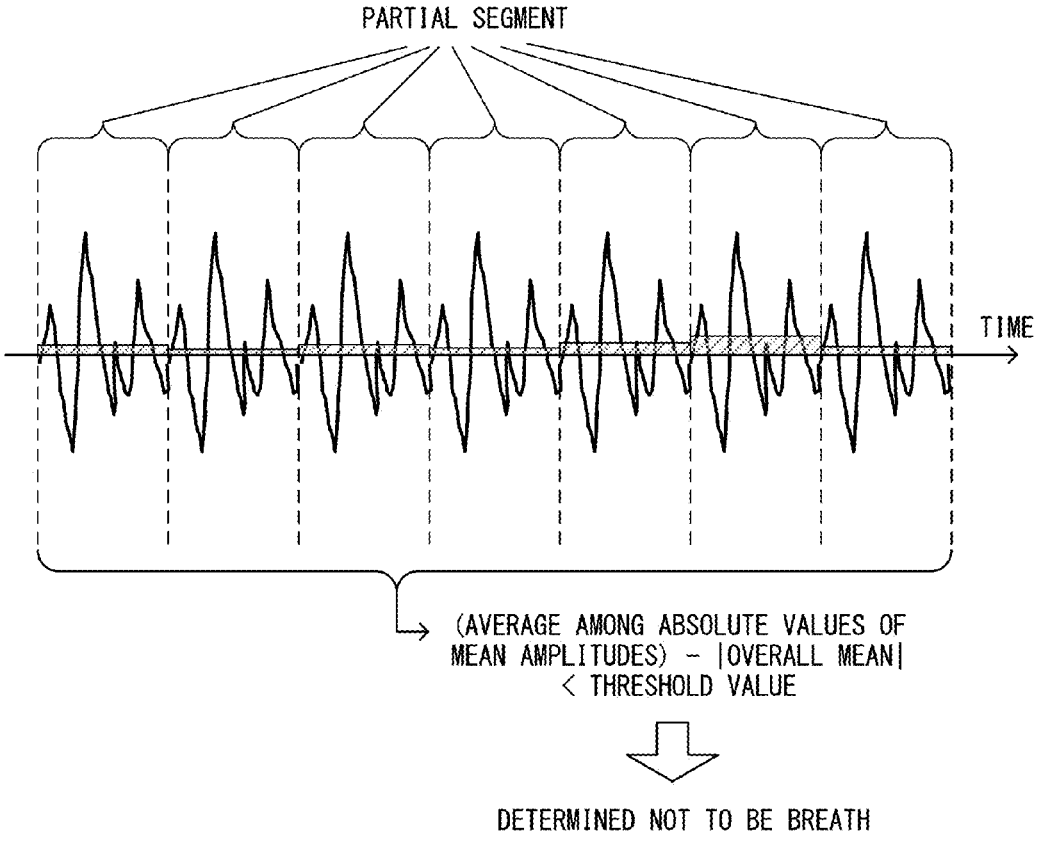
FIG. 7 is a diagram illustrating an example determination process for a sound of a waveform shown in (a) of FIG. 2.

FIG. 6 is a diagram illustrating an example determination process for a sound of a waveform shown in (b) of FIG. 2. FIG. 7 is a diagram illustrating an example determination process for a sound of a waveform shown in (a) of FIG. 2. As described above, if the sound of the determination segment is a breath, the absolute mean is large because (the absolute value of) the mean amplitude of the partial segment can be a relatively large value. As a result, the determination value becomes larger than the threshold value, and it is therefore determined that the sound of the determination segment is a breath as shown in FIG. 6. On the other hand, if the sound of the determination segment is a voice, (the absolute value of) the mean amplitude of the partial segment can be a relatively small value, and therefore the absolute mean is small. As a result, the determination value becomes less than or equal to the threshold value, and it is therefore determined that the sound of the determination segment is not a breath as shown in FIG. 7. Thus, according to the sound determination method of the present embodiment, it is possible to distinguish between a case where the detected sound is a voice and a case where it is a breath, and it is therefore possible to accurately determine breath blowing.

As described above, in the present embodiment, the information processing device 1 obtains data of a sound detected by a microphone, and calculates a mean amplitude of a sound of a predetermined determination segment for each of a plurality of partial segments included in the determination segment (FIG. 4, FIG. 5). Then, the information processing device 1 determines whether or not the sound input to the microphone is a predetermined type of a sound (a sound made by breath blowing) based on the mean amplitude for each partial segment. Thus, by calculating the mean amplitude for each partial segment, it is possible to know, by a simple method, the amount of frequency components below the frequency corresponding to the length of a partial segment. Therefore, according to the present embodiment, it is possible to determine, by a simple method, a sound made by breath blowing by using the mean amplitude without having to perform a complicated process such as frequency conversion and frequency spectrum pattern matching. Thus, it is possible to increase the speed of the process performed by the information processing device 1, and to simplify the configuration of the information processing device.

[3. Specific Example Process by Information Processing Device 1]

Figure 8:
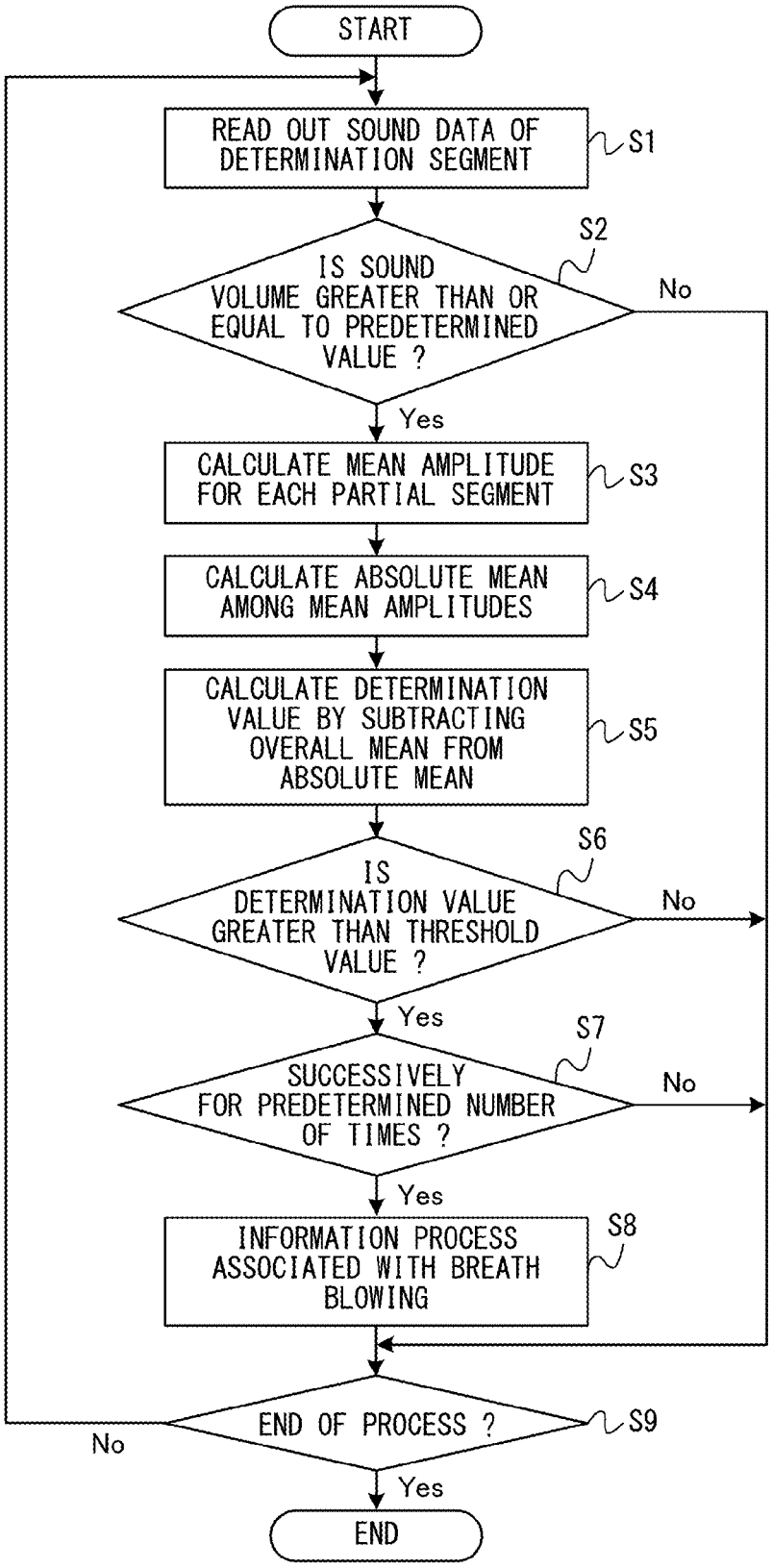
FIG. 8 is a flow chart showing an example of the flow of an information process performed by a processing section 4 of an information processing device 1 in the present embodiment.

Next, a specific example information process performed using the breath determination process described above to be performed by the information processing device 1 in the present embodiment will be described. FIG. 8 is a flow chart showing an example of the flow of an information process performed by the processing section 4 of the information processing device 1 in the present embodiment. In the present embodiment, a series of processes shown in FIG. 8 is performed by the CPU of the processing section 4 executing a predetermined information processing program stored in the program storing section 5.

The information process shown in FIG. 8 may be started at any point in time. In the present embodiment, the information process may be started in response to the user giving an instruction to start the execution of the information processing program, for example. A part or whole of the information processing program is loaded onto the memory of the processing section 4 at an appropriate point in time, and executed by the CPU. This starts the series of processes shown in FIG. 8. Note that it is assumed that the information processing program is pre-stored in the program storing section 5 in the information processing device 1. Note however that in an alternative embodiment, the information processing program may be obtained from a storage medium that can be attached/detached to/from the information processing device 1 so as to be stored in the memory, or may be obtained from another device via a network, such as the Internet, so as to be stored in the memory.

Note that the processes of steps in the flow chart shown in FIG. 8 are merely an example, and the order of steps may be changed or other processes may be performed in addition to (or instead of) the processes of steps, as long as similar results are achieved. While it is assumed in the present embodiment that the processes of steps in the flow chart are performed by the CPU, the processes of some steps in the flow chart may be performed by a processor or a dedicated circuit other than the CPU.

In the information process shown in FIG. 8, first, in step S1, the CPU obtains sound data of the determination segment. Now, in the present embodiment, the sound data obtained from the sound input section 2 is stored in a buffer in the information processing device 1. This buffer stores a predetermined length (the predetermined length is longer than the length of the determination segment) of a latest portion of sound data. The CPU reads out a length (equal to the length of the determination segment) of a latest portion of sound data and stores it in the memory.

In step S2, the CPU determines whether or not the sound volume over the determination segment is greater than or equal to a predetermined value. Note that the sound volume over the determination segment is calculated by the CPU as the average among absolute amplitude values of samples included in the sound data of the determination segment. If the determination result of step S2 is affirmative, the process of step S3 is performed. On the other hand, if the determination result of step S2 is negative, the process of step S9 is performed, skipping the series of processes of steps S3 to S8.

The processes of steps S3 to S8 are processes for determining whether or not the sound of a predetermined segment is a breath so as to perform a predetermined information process in response to a breath blowing, the details of which will be described later. That is, in the present embodiment, if the sound volume over the determination segment is low, the processing section 4 does not determine whether or not the sound of a predetermined segment is a breath and the processing section 4 does not perform the predetermined information process. Then, where a low-frequency sound, of which the sound volume is small but which is not a sound made by breath blowing, is detected (e.g., an ambient noise), it is possible to reduce the possibility that such a sound is determined erroneously as a breath. As a result, it is possible to more accurately perform the determination.

In step S3, the CPU calculates mean amplitude for each partial segment within the predetermined segment. Then, in step S4, the CPU calculates the average (the absolute mean) among the absolute values of the calculated mean amplitudes. Moreover, in step S5, the CPU calculates the overall mean described above, and obtains the determination value by subtracting the overall mean from the absolute mean. The processes in these steps S3 to S5 are described in "(Process to be performed on sound of determination segment)" above. Note that as a specific process in steps S3 to S5, the CPU calculates various values (the mean amplitude, the absolute mean, the overall mean, and the determination value) using the sound data of the predetermined segment read out from the memory, and stores the various values in the memory as necessary.

In step S6, the CPU determines whether or not the calculated determination value is greater than a threshold value. The determination process of step S6 is a process for determining whether or not the sound of the determination segment is a breath as described in "(Process to be performed on sound of determination segment)" above. Specifically, the CPU reads out data of the determination value and the threshold value stored in the memory, and determines whether or not the determination value is greater than the threshold value. If the determination result of step S6 is affirmative, the process of step S7 is performed. On the other hand, if the determination result of step S6 is negative, the process of step S9 is performed, skipping the series of processes of steps S7 to S8.

In step S7, the CPU determines whether or not the determination result of step S6 is affirmative successively for a predetermined number of times. That is, the determination of step S7 is a process of determining whether or not the sound of the determination segment has been determined to be a breath successively for a predetermined number of times. If the determination result of step S7 is affirmative, the process of step S8 is performed. On the other hand, if the determination result of step S7 is negative, the process of step S9 is performed, skipping the process of step S8.

In step S8, the CPU determines that a breath-blowing input has been made, and performs a predetermined information process associated with a breath-blowing input. The predetermined information process may be any process, and may be a process of moving an object in a game if the information processing program is a game program for performing game processes, for example. The CPU may vary the process depending on the strength of the breath. Note that the CPU may use the determination value itself as an index representing the strength of the breath, or may calculate the strength of the breath based on the determination value.

As shown in steps S7 and S8 described above, in the present embodiment, it is determined that a breath-blowing input has been made if the sound of the determination segment is determined to be a breath successively for a predetermined number of times. That is, the information processing device 1 determines whether or not a breath-blowing input has been made based on a plurality of determination results for a plurality of determination segments. Then, when the sound of the determination segment is determined erroneously to be a breath by chance (only once) due to a noise, or the like, the information process associated with a breath-blowing input is prevented from being performed, and the information process can be performed more accurately. Note that in an alternative embodiment, the information processing device 1 may determine whether or not a breath-blowing input has been made based on the number of times the sound of the determination segment has been determined to be a breath while the determination is made a predetermined number of times on the determination segment. In an alternative embodiment, the information processing device 1 may determine whether or not a breath-blowing input has been made based on a single determination result for the determination segment.

In step S9, the CPU determines whether or not to end the information processing program. This determination is made, for example, based on whether or not a user has given an instruction to end the execution of the information processing program. If the determination result of step S9 is negative, the process of step S1 is performed again. Thereafter, the series of processes of steps S1 to S9 are repeated until it is determined in step S9 to end the information processing program. On the other hand, if the determination result of step S9 is affirmative, the CPU ends the information process shown in FIG. 8.

Note that although not shown in FIG. 8, an alternative input other than a breath-blowing input (an input on the operation input section 3 and/or a voice input) may be detected/determined in the information process described above, and an information process associated with the alternative input may be performed.

[4. Variations]

(First Variation Regarding Calculation of Determination Value)

The embodiment described above uses a value obtained by subtracting the overall mean from the absolute mean, as the determination value based on which it is determined whether or not a breath-blowing input has been made. Now, in an alternative embodiment, the determination value may be another value based on the mean amplitude for each of a plurality of partial segments. For example, in an alternative embodiment, the determination value may be the absolute mean described above (i.e., the overall mean does not need to be used in the calculation of the determination value).

The information processing device 1 may calculate the average among the absolute values of the mean amplitudes for a plurality of partial segments (the absolute mean), as in the embodiment described above and the first variation, and may make the determination using the determination value which is based on the calculated mean. Such a mean can be said to be an index representing the amount of frequency components below the frequency corresponding to the length of a partial segment for the sound of the determination segment. Therefore, by using such a mean, it is possible to easily determine a particular type of a sound (a sound made by breath blowing) less than or equal to that frequency.

Note that in an alternative embodiment, the information processing device 1 may make the determination by using the total sum of the absolute values of the mean amplitudes for a plurality of partial segments. Also in this way, it is possible to make substantially the same determination as that when using the absolute mean, by adjusting the threshold value.

As described above, in the embodiment described above and the first variation, the information processing device 1 calculates the absolute value of the mean amplitude for each partial segment and determines whether or not the sound of the determination segment is a sound made by breath blowing based on the calculated absolute values. Therefore, since it is possible to make the determination based on the amount of frequency components below the frequency corresponding to the partial segment of the sound of the determination segment, the determination can be made precisely.

(Second Variation Regarding Calculation of Determination Value)

Next, a second variation, which is another variation regarding the calculation of the determination value, will be described. In the second variation, it is determined whether or not an input sound is breath blowing by distinguishing between a sound of a breath and a sound produced when a microphone hole is tapped by a finger, as well as distinguishing between a sound of a voice and a sound of a breath. Now, referring to FIGS. 9 to 11, details of the second variation will be described.

Figure 9:
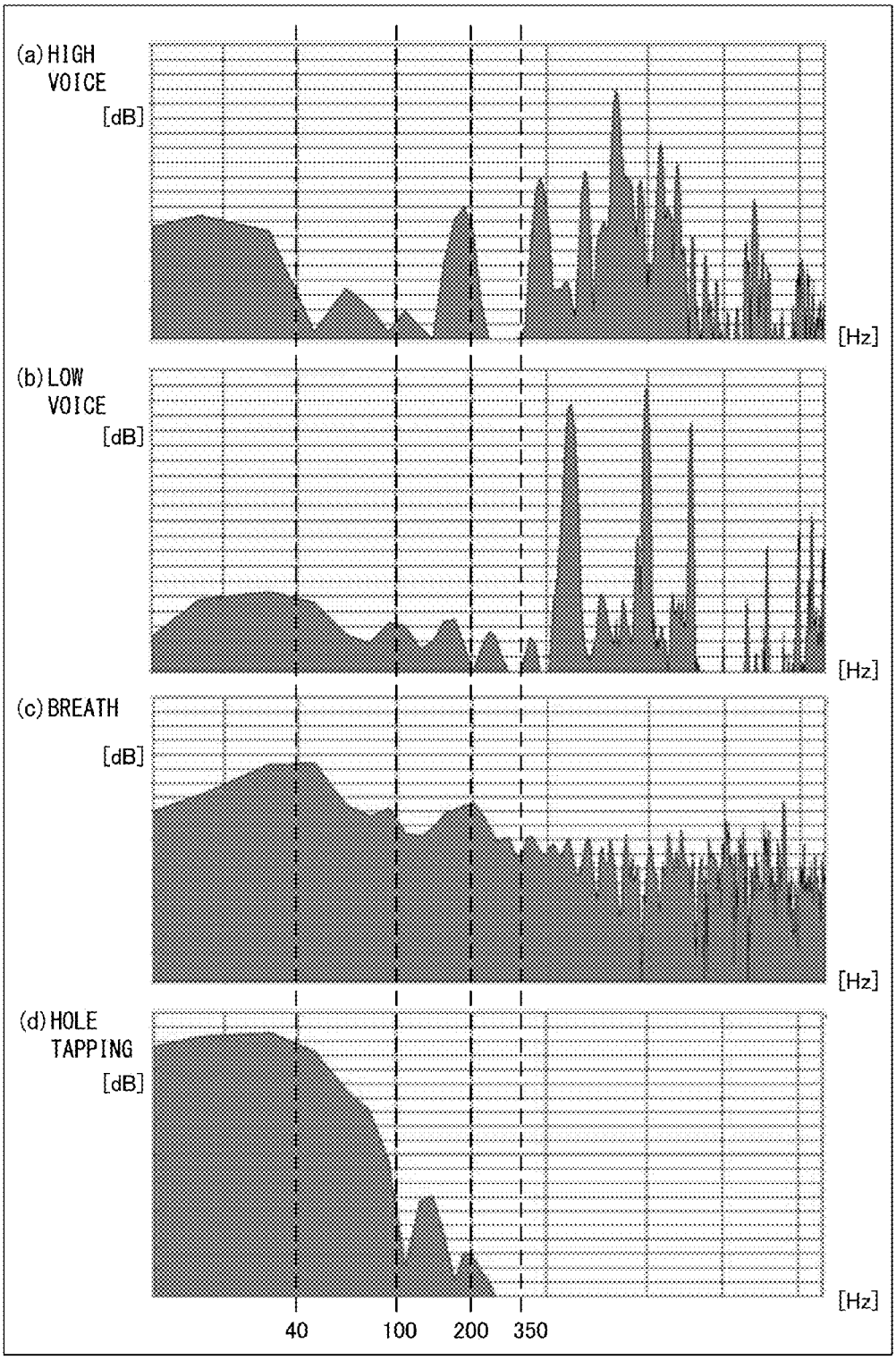
FIG. 9 is a diagram showing examples of frequency characteristics for a plurality of types of sounds.

FIG. 9 is a diagram showing examples of frequency characteristics for a plurality of types of sounds. The graph (a) shown in FIG. 9 shows frequency characteristics for a relatively high voice, and the graph (b) shown in FIG. 9 shows frequency characteristics for a relatively low voice. As can be seen from the graphs (a) and (b) of FIG. 9, a sound of a voice dominantly contains components of a higher frequency band (350 [Hz] or higher), and does not so much contain components of a lower frequency band (200 [Hz] or lower). On the other hand, the graph (c) shown in FIG. 9 shows frequency characteristics for a sound made by breath blowing. As can be seen from the graph (c) of FIG. 9, a sound made by breath blowing dominantly contains components of a lower frequency band (200 [Hz] or lower). Therefore, it is possible to detect breath blowing, distinguishing between a voice and a breath, by calculating the determination value so that it represents the amount of frequency components below a predetermined frequency (160 [Hz] in the embodiment described above), as described in the embodiment above. The breath determination process of the embodiment described above can be said to have the function of extracting frequency components below a predetermined frequency, by which function it is possible to distinguish between a voice and a breath.

Now, the microphone is placed inside the casing of the information processing device 1, and a microphone hole is formed in the casing in the vicinity of the microphone. The microphone detects a sound transmitted from outside of the information processing device 1 mainly through the microphone hole. Therefore, if a user taps the microphone hole with a finger (covers up the microphone hole with a finger), the wind pressure resulting from this action is detected by the microphone. The graph (d) of FIG. 9 shows frequency characteristics for a sound made by such a hole tapping action. As can be seen from the graph (d) of FIG. 9, a sound made by a hole tapping action dominantly contains components of a lower frequency band, as with a sound made by breath blowing. Therefore, with the breath determination process of the embodiment described above, the determination value for a sound made by a hole tapping action and the determination value for a sound made by breath blowing may not become substantially different from each other, thereby failing to distinguish between a sound made by a hole pressing action and a sound made by breath blowing. Note that where the microphone hole is provided on the surface of the casing of the information processing device 1 on which buttons are provided, for example, a user may accidentally tap the microphone hole as the user tries to press a button (the operation input section 3) of the information processing device 1. When a user taps the microphone hole, the information processing device 1 may erroneously determine that a breath-blowing input has been made.

Now, as shown in the graphs (c) and (d) of FIG. 9, a sound made by breath blowing and a sound made by a hole tapping action differ from each other in that a sound made by breath blowing also contains a certain amount of frequency components above 100 [Hz], whereas the amount of frequency components drops above 100 [Hz] for a sound made by a hole tapping action. Therefore, if the determination value can be calculated so as to represent the amount of frequency components above around 100 [Hz], it is possible to distinguish between a sound made by a hole tapping action and a sound made by breath blowing.

In view of this, in the second variation, the information processing device 1 calculates the determination value so as to represent the amount of frequency components over a predetermined frequency band from a frequency on the lower-frequency side to another frequency on the higher-frequency side so as to distinguish between a sound made by a hole tapping action and a sound made by breath blowing, in addition to distinguishing between a sound of a voice and a sound made by breath blowing. While the breath determination process of the embodiment described above has a function of only extracting components below a predetermined first frequency, the breath determination process of the second variation can be said to have, in addition to this function, another function of extracting components above a predetermined second frequency. The details of the breath determination process of the second variation will now be described.

Figure 10:
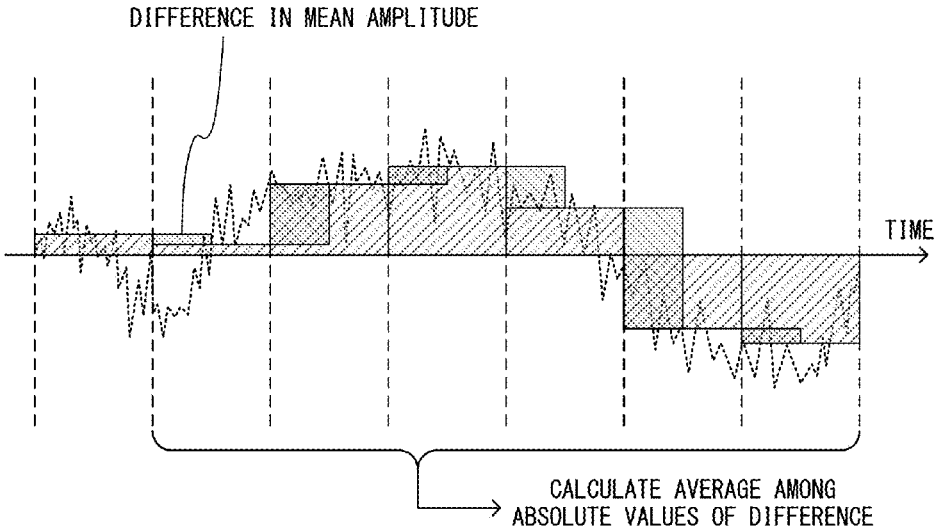
FIG. 10 is a diagram showing an example of a determination value calculation method of a second variation.

FIG. 10 is a diagram showing an example of a determination value calculation method of the second variation. Also in the second variation, as in the embodiment described above, the mean amplitude is calculated for each partial segment, as shown in FIG. 10. Note that also in the second variation, as in the embodiment described above, the length of a partial segment is set to a length corresponding to a frequency with which it is possible to distinguish between a sound of a voice and a sound made by breath blowing. Specifically, the length of a partial segment in the second variation is set to a length corresponding to 200 [Hz], i.e., 1/400 [sec].

Next, in the second variation, the information processing device 1 calculates the difference between each pair of two mean amplitudes for two partial segments of the determination segment next to each other (see FIG. 10). As shown in FIG. 10, also in the second variation, as in the embodiment described above, there are seven partial segments included in the determination segment, and therefore a total of six difference values are calculated.

The information processing device 1 further calculates the absolute value of each difference so as to calculate the average among the absolute values of the differences (referred to as the "mean difference") as the determination value. The information processing device 1 determines whether or not the sound of the determination segment is a breath by using the determination value calculated as described above. Specifically, the information processing device 1 determines that the sound of the determination segment is a breath if the determination value is greater than a predetermined threshold value, and determines that the sound of the determination segment is not a breath if the determination value is less than or equal to the threshold value. Note that in an alternative embodiment, the information processing device 1 may calculate the determination value by subtracting the overall mean from the mean difference, or may calculate the total sum of the differences as the determination value.

Note that as a specific process of the second variation, the CPU of the processing section 4 performs the following process instead of steps S4 and S5 in the series of processes shown in FIG. 8. That is, following the process of step S3, the CPU calculates the differences, and further calculates the mean difference as the determination value. After calculating the mean difference, the CPU performs the process of step S6 shown in FIG. 8. Note that in the second variation, as for processes other than steps S4 and S5, the CPU performs processes similar to those of the embodiment described above.

As described above, in the second variation, the difference between each pair of two mean amplitudes for two partial segments next to each other within the determination segment is calculated, and it is determined whether or not the sound of the determination segment is a breath by using the determination value which is based on the absolute values of the differences. Now, where x is the mean amplitude for one partial segment A, and y is the mean amplitude for the following partial segment B, the absolute value of the difference $|y-x|$ is equal to the sum of (a) and (b) below.

(a) the absolute value $|x/2-y/2|$ of a value obtained by subtracting the overall mean amplitude $\{(x+y)/2\}$ for the two partial segments from the mean amplitude x of the first partial segment A; and (b) the absolute value $|y/2-x/2|$ of a value obtained by subtracting the overall mean amplitude $\{(x+y)/2\}$ for the two partial segments from the mean amplitude y of the second partial segment B.

(a) and (b) above each represent an amount obtained by removing components below the frequency ω2 (herein, 100 [Hz]) corresponding to the length of two partial segments from components below the frequency ω1 (herein, 200 [Hz]) corresponding to the length of one partial segment. That is, (a) and (b) above and the absolute value of the difference, which is the sum of (a) and (b), can be said to be an index representing the amount of components over a frequency band of ω1 to ω2. Therefore, in the second variation, it is possible to determine whether or not the sound of the determination segment is a sound made by breath blowing based on whether or not the amount of components over the frequency band of ω1 to ω2 is greater than a predetermined value.

As described above, according to the second variation, it is possible to detect a sound having a large amount of components over the frequency band of ω1 to ω2, and it is therefore possible to determine whether or not a sound is a sound made by breath blowing by distinguishing between a sound made by a hole tapping action and a sound made by breath blowing, in addition to distinguishing between a voice and a breath.

(Third Variation Regarding Calculation of Determination Value)

Next, a third variation, which is another example for distinguishing between a sound made by a hole tapping action and a sound made by breath blowing in a breath determination process, will be described. In the second variation described above, the information processing device 1 calculates the absolute value of the difference between mean amplitudes for two partial segments next to each other, thereby excluding components below the frequency corresponding to the length of two partial segments. In the third variation, the mean amplitude for an entire group segment, which is made up of two or more partial segments, is calculated, so as to calculate the difference between the mean amplitude for a partial segment and the mean amplitude for an entire group segment. Therefore, in the third variation, a breath determination process is performed by excluding components below the frequency corresponding to the length of two or more partial segments. The details of the third variation will now be described.

Figure 11:
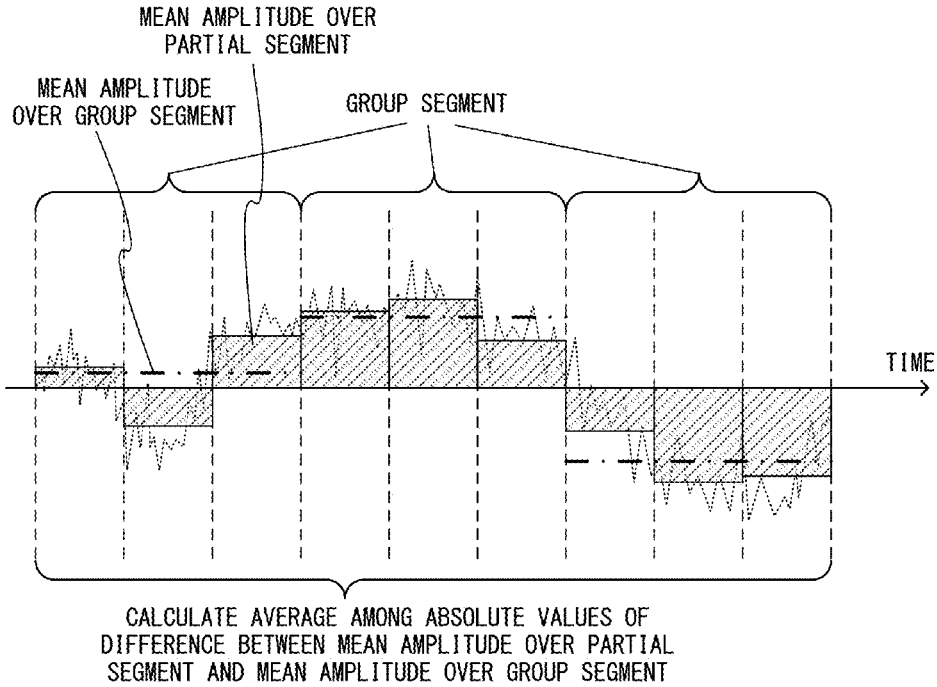
FIG. 11 is a diagram showing an example of a determination value calculation method of a third variation.

FIG. 11 is a diagram showing an example of a determination value calculation method of the third variation. In the third variation, group segments are set within the determination segment. As shown in FIG. 11, a group segment is a segment made up of a predetermined number (two or more; three in FIG. 11) of successive partial segments in the determination segment. In FIG. 11, one determination segment includes nine partial segments, and the nine partial segments are grouped into three group segments, each including three partial segments.

In the third variation, the mean amplitude for each partial segment is calculated, as in the embodiment described above. Moreover, in the third variation, the information processing device 1 calculates, for each group segment, the mean amplitude for the group segment (referred to as the "group mean amplitude"; see the one-dot-chain line shown in FIG. 11). Next, the information processing device 1 calculates, for each partial segment, the difference between the mean amplitude for the partial segment and the group mean amplitude for a group segment corresponding to the partial segment (including the partial segment). The information processing device 1 calculates the average among the absolute values of the differences for different partial segments, as the determination value. The information processing device 1 determines whether or not the sound of the determination segment is a breath by using the determination value calculated as described above. Note that in an alternative embodiment, the information processing device 1 may calculate the determination value by subtracting the overall mean from the average among the absolute values of the differences, or may calculate the total sum of the absolute values of the differences as the determination value.

Note that as a specific process of the third variation, the CPU of the processing section 4 performs the following process instead of steps S4 and S5 in the series of processes shown in FIG. 8. That is, following the process of step S3, the CPU calculates each group mean amplitude, and calculates, for each partial segment, the difference between the mean amplitude for the partial segment and the group mean amplitude. Then, the average among the absolute values of the differences is calculated as the determination value. After calculating the determination value, the CPU performs the process of step S6 shown in FIG. 8. Note that in the third variation, as for processes other than steps S4 and S5, the CPU performs processes similar to those of the embodiment described above.

As described above, in the third variation, the information processing device 1 calculates, for each partial segment, the difference between the mean amplitude for one partial segment and the group mean amplitude for a group segment corresponding to the partial segment, and makes a determination by using the determination value which is based on the absolute values of the differences. Now, the group mean amplitude represents the amount of components below the frequency ω3 corresponding to the length of the group segment in the sound of the determination segment. Therefore, the difference in the third variation can be said to be an index representing the amount of components over a frequency band from the frequency ω1 (corresponding to the length of one partial segment) to the frequency ω3. Therefore, in the third variation, it is possible to determine whether or not the sound of the determination segment is a sound made by breath blowing based on whether or not the amount of components over the frequency band of ω1 to ω3 is greater than a predetermined value. Thus, as is the second variation, the third variation can be said to be a process of removing (reducing) components above a predetermined frequency on the higher-frequency side and removing (reducing) components below a predetermined frequency on the lower-frequency side from the sound of the determination segment.

As described above, according to the third variation, it is possible to detect a sound having a large amount of components over the frequency band of ω1 to ω3, and it is therefore possible to determine whether or not a sound is a sound made by breath blowing by distinguishing between a sound made by a hole tapping action and a sound made by breath blowing, in addition to distinguishing between a voice and a breath.

Note that the value of the frequency ω3 can be adjusted based on the length of one partial segment and the number N of partial segments included in a group segment. That is, the frequency ω3 is a value obtained by dividing the frequency ω1 corresponding to the length of one partial segment by the number N. Therefore, in the third variation, the value of the frequency ω1 can be adjusted by the length of a partial segment, and the value of the frequency ω3 can be adjusted by the number N, and it is therefore possible to adjust, in greater detail, the frequency to be extracted from the sound of the determination segment. Note that the second variation described above provides similar effects to those of the third variation where the number N is set to two.

Note that while a plurality of partial segments are associated with the same group segment in the third variation, a different group segment may be set for each partial segment in an alternative embodiment. For example, in an alternative embodiment, a group segment for a certain partial segment may be a segment of three partial segments, including the certain partial segment and two other partial segments on opposite sides thereof and successive therewith. Note that in such a case, a group segment cannot be set for the first partial segment and the last partial segment of the determination segment, and the information processing device 1 may therefore be configured not to calculate the difference for the first and last partial segments.

(Variation Regarding Determination Method Using Determination Value)

In the embodiment described above and the first to third variations, the information processing device 1 determines whether or not the sound of the determination segment is a sound made by breath blowing based on the comparison between the determination value and a predetermined threshold value. Thus, it is possible to make the determination by a simpler process.

On the other hand, in an alternative embodiment, the information processing device 1 may make the above determination based on the ratio of the determination value with respect to the sound volume over the determination segment. That is, the information processing device 1 may determine that the sound of the determination segment is a sound made by breath blowing if the ratio is greater than a predetermined threshold value, and that the sound of the determination segment is not a sound made by breath blowing if the ratio is less than or equal to the threshold value. Then, the determination can be made more precisely. Note that the determination value as used herein may be the determination value of the embodiment described above, or the determination value of the first to third variations.

(Variation Regarding Determination Segment)

In the embodiment described above, the sound data of the determination segment is obtained in the process of step S1 in the process loop of steps S1 to S9. That is, in the embodiment described above, if the time interval with which step S1 is performed (the interval between when the process of step S1 is performed and when the process of step S1 is next performed again) is shorter than the length of the determination segment, one determination segment will overlap with the following determination segment. Now, the method for setting the determination segment may be any method, and the determination segment may be set so that one determination segment and the following determination segment overlap with each other as in the embodiment described above; may be set so that there is a gap between one determination segment and the following determination segment; or may be set so that one determination segment and the following determination segment are successive with each other (with no overlap therebetween).

(Variation Regarding Partial Segment)

In the embodiment described above, partial segments included in one determination segment are set to the same length. Now, in an alternative embodiment, the lengths of the partial segments do not need to be exactly the same, but may be set to be generally the same. Then, it is possible to precisely make the determination based on the amount of components below a predetermined frequency which is determined based on the length of a partial segment of the sound of the determination segment.

In the embodiment described above, the partial segments included in one determination segment are set to be successive with one another with no gap therebetween (see FIG. 3). Note however that in an alternative embodiment, two partial segments next to each other may not be adjacent to each other and may be arranged with a gap therebetween.

The number of partial segments included in one determination segment is arbitrary. Note however that the number of partial segments may be set to be five or more, for example, taking into consideration the possible decrease in determination precision when the number of partial segments is small.

The length of a partial segment may be appropriately set in view of frequencies of types of sounds to be extracted (types of sounds to be excluded). Where a sound made by breath blowing is to be extracted while excluding a sound of a voice as in the embodiment described above, the partial segment is desirably set to a length corresponding to the frequency of 350 [Hz], i.e., a length of 1/700 [sec] or more. As can be seen from FIG. 9, a sound of a voice has a small amount of components below 350 [Hz], whereas a sound made by breath blowing has a sufficient amount of components below 350 [Hz], and it is therefore possible to distinguish between a voice and a breath by setting the partial segment to a length corresponding to 350 [Hz]. Note that in order to better exclude a sound component of a voice, the length of a partial segment may be set to a length corresponding to 200 [Hz], i.e., a length greater than or equal to 1/400 [sec].

Note that in order to extract a sound made by breath blowing while excluding a sound made by a hole tapping action as in the second variation and the third variation, the partial segment is desirably set to a length corresponding to the frequency of 40 [Hz], i.e., a length less than or equal to 1/80 [sec]. As can be seen from FIG. 9, a sound made by a hole tapping action has a relatively small amount of components above 40 [Hz], whereas a sound made by breath blowing has a sufficient amount of components above 40 [Hz], and it is therefore possible to distinguish between these two types of sounds by setting the length of a partial segment to a length corresponding to 40 [Hz]. Note that in order to better exclude components of a sound made by a hole tapping action, the length of a partial segment may be set to a length corresponding to 100 [Hz], i.e., a length greater than or equal to 1/200 [sec].

(Variation Regarding Types of Sounds to be Determined)

In the embodiment described above, the information processing device 1 determines whether or not a sound input to a microphone is a sound made by breath blowing. Now, the type of the sound to be determined by the information processing device 1 is not limited to a sound made by breath blowing but may be any other type of a sound. For example, in an alternative embodiment, the information processing device 1 may determine whether or not a sound input to a microphone is a sound made by a voice. For example, it is possible to extract a sound made by a voice by excluding a sound made by breath blowing (and a sound made by a hole tapping action) by adjusting the length of a partial segment (e.g., setting it to 1/800 [sec] so as to extract a frequency band over the range of 400 [Hz] to 800 [Hz]) in the second variation described above. Alternatively, it is possible to extract a sound made by a voice by excluding a sound made by breath blowing (and another sound of a frequency higher than a sound made by a voice) by adjusting the length of a partial segment and the number of partial segments included in a group segment in the third variation described above. By these methods, it is possible to determine whether or not a sound input to a microphone is a sound made by a voice.

In the embodiment described above, the information processing device 1 does not perform an information process associated with a determination result where it has been determined that the sound of the determination segment is not a sound made by breath blowing, but in an alternative embodiment, the information processing device 1 may perform a predetermined information process in such a case. For example, the hole tapping action not taken into account, if it is determined that the sound of the determination segment is not a sound made by breath blowing (and if the sound volume is greater than or equal to a predetermined value), the information processing device 1 may determine that a sound input has been made and may perform an information process associated with a voice input.

The systems, devices and apparatuses described herein may include one or more processors, which may be located in one place or distributed in a variety of places communicating via one or more networks. Such processor(s) can, for example, use conventional 3D graphics transformations, virtual camera and other techniques to provide appropriate images for display. By way of example and without limitation, the processors can be any of: a processor that is part of or is a separate component co-located with the stationary display and which communicates remotely (e.g., wirelessly) with the movable display; or a processor that is part of or is a separate component co-located with the movable display and communicates remotely (e.g., wirelessly) with the stationary display or associated equipment; or a distributed processing arrangement some of which is contained within the movable display housing and some of which is co-located with the stationary display, the distributed portions communicating together via a connection such as a wireless or wired network; or a processor(s) located remotely (e.g., in the cloud) from both the stationary and movable displays and communicating with each of them via one or more network connections; or any combination or variation of the above.

The processors can be implemented using one or more general-purpose processors, one or more specialized graphics processors, or combinations of these. These may be supplemented by specifically-designed ASICs (application specific integrated circuits) and/or logic circuitry. In the case of a distributed processor architecture or arrangement, appropriate data exchange and transmission protocols are used to provide low latency and maintain interactivity, as will be understood by those skilled in the art.

Similarly, program instructions, data and other information for implementing the systems and methods described herein may be stored in one or more on-board and/or removable memory devices. Multiple memory devices may be part of the same device or different devices, which are co-located or remotely located with respect to each other.

As described above, the embodiment and the variations described above are applicable as an information processing device or an information processing program for performing a process associated with a breath-blowing input, for example, with the aim of determining an input sound by a simple method.

While certain example systems, methods, devices and apparatuses have been described herein, it is to be understood that the appended claims are not to be limited to the systems, methods, devices and apparatuses disclosed, but on the contrary, are intended to cover various modifications and equivalent arrangements included within the spirit and scope of the appended claims.

What is claimed is:

1. An information processing system for determining a sound input to a microphone, wherein:

the information processing system comprises one or more processors configured to execute:

obtaining data of a sound detected by the microphone;

for a sound of a predetermined determination segment, calculating a mean amplitude, which is an average amplitude, by using the obtained data of the sound, for each of a plurality of partial segments included in the determination segment; and determining whether or not the sound input to the microphone is a predetermined type of a sound based on the mean amplitudes for the partial segments, wherein an absolute value of the mean amplitude for each partial segment is calculated, and the determination is made based on the calculated absolute values, wherein an average value among the absolute values is calculated, and the determination is made based on a determination value which is based on the calculated average value, and wherein the determination is made based on a ratio of the determination value with respect to a sound volume over the determination segment.

2. The information processing system according to claim 1, wherein the computer determines whether or not a sound input to the microphone is a sound made by breath blowing.

3. The information processing system according to claim 1, wherein a plurality of partial segments included in the determination segment are set to a generally equal length.

4. The information processing system according to claim 1, wherein the partial segment is set to a length of 1/700 or more.

5. The information processing system according to claim 1, wherein the partial segment is set to a length of 1/400 or more.

6. An information processing system for determining a sound input to a microphone, wherein:

the information processing system comprises one or more processors configured to execute:

obtaining data of a sound detected by the microphone;

for a sound of a predetermined determination segment, calculating a mean amplitude, which is an average amplitude, by using the obtained data of the sound, for each of a plurality of partial segments included in the determination segment; and determining whether or not the sound input to the microphone is a predetermined type of a sound based on the mean amplitudes for the partial segments, wherein a difference between two mean amplitudes for two partial segments next to each other within the determination segment is calculated for each pair of two partial segments next to each other, and the determination is made by using a determination value which is based on absolute values of the differences.

7. The information processing system according to claim 6, wherein the determination is made based on a comparison between the determination value and a predetermined threshold value.

8. The information processing system according to claim 6, wherein the determination is made based on a ratio of the determination value with respect to a sound volume over the determination segment.

9. The information processing system according to claim 6, wherein the computer determines whether or not the sound input to the microphone is a sound made by a voice.

10. An information processing system for determining a sound input to a microphone, wherein:

the information processing system comprises one or more processors configured to execute:

obtaining data of a sound detected by the microphone;

for a sound of a predetermined determination segment, calculating a mean amplitude, which is an average amplitude, by using the obtained data of the sound, for each of a plurality of partial segments included in the determination segment; and determining whether or not the sound input to the microphone is a predetermined type of a sound based on the mean amplitudes for the partial segments, wherein a difference between a mean amplitude for one partial segment and a mean amplitude for a group segment, which is made up of two or more successive partial segments including the one partial segment, is calculated for each partial segment, and the determination is made by using a determination value which is based on absolute values of the differences.

11. The information processing system according to claim 10, wherein the determination is made based on a comparison between the determination value and a predetermined threshold value.

12. The information processing system according to claim 10, wherein the determination is made based on a ratio of the determination value with respect to a sound volume over the determination segment.

13. The information processing system according to claim 10, wherein the computer determines whether or not the sound input to the microphone is a sound made by a voice.

14. A sound determination method to be carried out on an information processing device for determining a sound input to a microphone, the method comprising:

obtaining data of a sound detected by the microphone;

for a sound of a predetermined determination segment, calculating a mean amplitude, which is an average amplitude, by using the obtained data of the sound, for each of a plurality of partial segments included in the determination segment; and determining whether or not the sound input to the microphone is a predetermined type of a sound based on the mean amplitudes for the partial segments, wherein an absolute value of the mean amplitude for each partial segment is calculated, and the determination is made based on the calculated absolute values, wherein an average value among the absolute values is calculated, and the determination is made based on a determination value which is based on the calculated average value, and wherein the determination is made based on a ratio of the determination value with respect to a sound volume over the determination segment.

15. A sound determination method to be carried out on an information processing device for determining a sound input to a microphone, the method comprising:

obtaining data of a sound detected by the microphone;

for a sound of a predetermined determination segment, calculating a mean amplitude, which is an average amplitude, by using the obtained data of the sound, for each of a plurality of partial segments included in the determination segment; and determining whether or not the sound input to the microphone is a predetermined type of a sound based on the mean amplitudes for the partial segments, wherein a difference between two mean amplitudes for two partial segments next to each other within the determination segment is calculated for each pair of two partial segments next to each other, and the determination is made by using a determination value which is based on absolute values of the differences.

16. A sound determination method to be carried out on an information processing device for determining a sound input to a microphone, the method comprising:

obtaining data of a sound detected by the microphone;

for a sound of a predetermined determination segment, calculating a mean amplitude, which is an average amplitude, by using the obtained data of the sound, for each of a plurality of partial segments included in the determination segment; and determining whether or not the sound input to the microphone is a predetermined type of a sound based on the mean amplitudes for the partial segments, wherein a difference between a mean amplitude for one partial segment and a mean amplitude for a group segment, which is made up of two or more successive partial segments including the one partial segment, is calculated for each partial segment, and the determination is made by using a determination value which is based on absolute values of the differences.

* * * * *